US006241623B1

(12) United States Patent
Laibangyang

(10) Patent No.: US 6,241,623 B1
(45) Date of Patent: Jun. 5, 2001

(54) GOLF CLUB WITH ADJUSTABLY FLEXIBLE SHAFT

(76) Inventor: Charnnarong Laibangyang, 1066 Hillside St., Monterey Park, CA (US) 91754

( * ) Notice: Subject to any disclaimer, the term of this patent is extended or adjusted under 35 U.S.C. 154(b) by 0 days.

(21) Appl. No.: 09/553,594

(22) Filed: Apr. 20, 2000

Related U.S. Application Data

(60) Provisional application No. 60/170,772, filed on Dec. 15, 1999.

(51) Int. Cl.[7] ..... A63B 69/36

(52) U.S. Cl. ..... 473/232; 473/238; 473/289; 473/316; 473/318

(58) Field of Search ..... 473/316, 317, 473/318, 319, 320, 321, 322, 323, 282, 289, 219, 231, 232, 233, 223, 226, 227, 256, 300, 520, 238

(56) References Cited

U.S. PATENT DOCUMENTS 1,590,469 * 6/1926 Marsh .
2,801,106 * 7/1957 Koehler .
2,992,828 7/1961 Stewart .
3,318,602 * 5/1967 Kunisha .
3,833,223 * 9/1974 Shulkin .
4,214,395 * 7/1980 Caldwell .
4,685,682 8/1987 Isabell .
5,226,652 * 7/1993 Sato .
5,865,688 2/1999 Bae .
5,931,744 8/1999 Hackman .

* cited by examiner

*Primary Examiner*—Sebastiano Passaniti
(74) *Attorney, Agent, or Firm*—Edward Gray

(57) ABSTRACT

A golf club having a hollow shaft whose flexibility is altered by rotating the club handle. Change in flexibility results from change in tension on a wire coinciding with the shaft longitudinal axis. The wire is attached between a longitudinally movable assembly in the handle and a fixed assembly at the shaft lower end. The movable assembly includes outer and inner tension tuner members, a collar, a clamp and bifurcated collet, and outer and inner twist-prevention housings.

8 Claims, 3 Drawing Sheets

GOLF CLUB WITH ADJUSTABLY FLEXIBLE SHAFT

CROSS-REFERENCE TO RELATED APPLICATION

This application claims benefit of priority of U.S. Provisional Patent Application Ser. No. 60/170,772, entitled "Adjustable Flexibility Golf Club Shaft," filed on Dec. 15, 1999.

BACKGROUND OF THE INVENTION

1. Field of the Invention

This invention relates to golf clubs, and more particularly to a wood or iron having a shaft whose flexibility can be incrementally increased or decreased while playing or practicing.

2. Description of the Related Art

A golf swing is a set of highly complex body movements requiring precise coordination of the hands, arms, shoulders, torso, hips, legs and knees, occurring in proper sequence. As the body coils and then uncoils, power is transferred from the body through the arms and wrists to the club grip, along the shaft, into the clubhead, and into the ball.

In a full range of motion swing, the position of the leading arm (i.e., the left arm of a right-handed golfer, or the right arm of a left-handed golfer) is critically important. The backswing is performed as a unitary motion, the entire front side of the body moving together as the knees, hips, trunk and shoulders are rotated, with the leading arm pushing the trailing arm back, and the leading elbow and arm remaining straight. To achieve the broadest possible swing arc, the club is swung straight back from the ball, without breaking the wrists, for as long as the turning of the shoulders and hips will allow. The golfer tries to keep the clubface square to the target line for as long as possible without turning the hands and wrists under, and also tries to keep the leading arm and club in a straight line until the momentum of the swinging clubhead causes the wrists to begin cocking naturally as they reach about hip height. The angle between the hands and shaft is maintained, with the trailing arm bending at the elbow and the leading arm remaining straight. The one-piece motion forces the shoulders to turn from the very beginning of the backswing and ensures they will go on turning until the top of the swing is reached. As the arms stretch and turn, the hips are also forced to turn. At the top of the backswing, the shoulders have turned about twice as far as the hips, the leading arm is straight, and the forearms have rotated. The leading forearm is pronated, i.e., rotated clockwise for a right-handed golfer or rotated counterclockwise for a left-handed golfer, and the trailing forearm is supinated, i.e., rotated counterclockwise for a right-handed golfer or rotated clockwise for a left-handed golfer, causing cocking of the wrists with the shaft generally perpendicular to the leading forearm. Ideally, the back of the leading hand, the wrist and the forearm are in a straight line, with the shaft parallel to the ground and to the target line, and the clubhead pointing toward the target.

As the arms reach their fullest extension and the weight of the clubhead causes the wrists to attain their maximum cocking but before the hands reach their highest level or the shoulders finish turning, the lower torso, hips, legs and feet already have initiated the downswing. The golfer pushes hard off the inside of the back foot, throwing weight to the inside of the front foot. The front knee is pulled laterally toward the target and is well forward of the ball before the hands have descended even a few inches. The wrists are kept cocked and the head is kept back behind the ball. The club is pulled into action by the uncoiling of the body and leading arm. Because of the movement of the lower body toward the target and the delay in uncocking the wrists, the arc traversed by the clubhead on the downswing is steeper than the arc on which the clubhead was taken back.

In the hitting zone the hips, which were moving laterally in the same forward direction as the knees, begin to turn with respect to the target line. By turning, the hips "clear" a path for the arms to swing past the body. The thrusting legs and hips, by forcing the shoulders to turn, accelerate the arms and club. Just before impact, a point is reached where no further acceleration is possible and, because of centrifugal force, the club must be released into the ball. At that point, the wrists are forced to uncock spontaneously.

As the wrists uncock and the back arm starts to straighten, the fully released clubhead whips toward the ball. At impact, the back of the leading hand faces the target, and the leading arm and shaft form a straight line so that the leading hand and arm are slightly ahead of the ball. As the clubhead swings through the ball toward the target, the leading arm is kept straight and moves directly toward the target. The golfer must avoid any independent turning or twisting of the club with the hands and wrists.

The release phase is entered just after impact. The trailing arm straightens, but there is no breaking down of the leading arm at the wrist or elbow. Nor is there independent rolling, turning or twisting of the hands, wrists or forearms, until the momentum of the club, combined with the turning body, forces the body to turn and swing to the opposite side of the target line. The leading arm is supinated and the trailing arm is pronated, the forearms being opposite to their rotational position at the top of the backswing.

As millions of golfers can attest, it is difficult to meld the separate motions comprising a full range of motion swing so as to achieve impact with the clubface generally square to the ball while the clubhead is moving at a high rate of speed. The present invention entails increasing clubhead speed by flexing the shaft to impart to potential energy additional to that accumulated during the backswing, which is converted into extra clubhead kinetic energy in the hitting zone and at impact.

Golf clubs having shafts with modifiable flexure are disclosed in the related art. U.S. Pat. No. 2,992,828 to W. A. Stewart discloses a club having a hollow shaft which is prestressed so as to remain relatively straight during the backswing and downswing, compared to a conventional shaft. In one embodiment a wire inside the shaft and adjacent to the leading edge is maintained under tension between plugs at the top and bottom ends of the shaft. The upper plug receives a bolt which when rotated causes the plug to act as a nut and travel upwardly on the bolt, increasing tension in the wire and thereby compressing the shaft leading edge. Tightening the wire tends to bow the shalt in a direction opposite to the direction the shaft would normally bend on the downswing. The wire is not tensioned sufficiently to bow the shaft but just enough to prestress the shaft or apply a bending stress in a direction opposite to the bending stress applied to the shaft during the downswing. In another embodiment an elongated column member extending the length of the shaft between upper and lower plugs has its trailing edge compressed by screwing a bolt down through the upper plug. This puts tension on the trailing side of the shaft, inducing a bending stress in the shaft opposite to the downswing bending stress.

U.S. Pat No. 4,685,682 to J. T. Isabell discloses a golf club connected to a mechanism which increases or decreases shaft flexibility by varying the tension in a wire extending between the handle and clubhead. The wire is offset from the shaft by a bridge which maximizes the effect of small changes in wire tension provided by movement of a threaded connection between the wire and clubhead. Increasing the tension in the mechanism decreases shaft flexibility; decreasing the tension increases flexibility. The device is used to determine the degree of shaft flexibility which maximizes an individual golfer's clubhead speed at impact, so that a set of clubs can be made that have the same flex characteristics.

U.S. Pat. No. 5,865,688 to S. W. Bae discloses a golf club having three flex points along its shaft. At each point, the shaft diameter expands to permit the shaft to flex at that point. When the club is swung, the shaft flexes from a high flex point (i.e., a location proximate to the handle) to a mid flex point to a low flex point (i.e., a location proximate to the clubhead).

U.S. Pat. No. 5,931,744 to L. E. Hackman discloses a method for reducing the stiffness of a hollow golf club shaft divided into three segments with each pair of segments connected by cone-shaped bands. The stiffness is changed by slicing or abrading the inner surface of the sidewall which typically is made from a flexible matrix material such as an epoxy, in which elongated, high strength graphite fibers are embedded. Most of the fibers are arranged longitudinally to provide strength and stiffness to resist bending of the shaft. Severing or removing selected fibers reduces the longitudinal stiffness.

None of these references address the problem of providing a golf club whose shaft easily can be made more or less flexible so that a golfer can determine through experimental trial which degree of flexibility best suits his particular full range of motion swing.

OBJECTS OF THE INVENTION

In view of the limitations of the related art, it is an object of the present invention to provide a golf club incorporating a device which allows a player to easily increase or decrease shaft flexibility when playing or practicing.

Another object of the invention is to provide a golf club whose shaft flexibility is adjustable with the adjustment calibrated so that any particular state within a range of flexibility can be accurately reproduced.

A further object of the invention is to provide a golf club whose shaft imparts kinetic energy to the clubhead in the hitting zone and at impact, additional to that generated in the downswing of a conventional club.

Yet another object of the invention is to provide a device altering shaft flexibility which is reliable to operate, inexpensive to manufacture, and readily adaptable to any club having a hollow shaft and clubhead.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

These and other objects are achieved by the present invention which in one aspect provides a golf club including a handle with a cavity rotatably connected to a hollow shaft upper portion symmetric about a longitudinal axis. The club further includes a hollow flexible shaft central portion attached to the shaft upper portion and a hollow shaft lower portion both symmetric about the axis. The club further includes means for altering the tension on a metallic wire disposed along the axis whose upper end is longitudinally adjustable within the handle cavity, and whose lower end is attached to the shaft lower portion at its lower end.

In another aspect the invention provides a golf club including a handle having a cap portion and a rotatable grip upper portion with a cylindrical interior surface determining a cavity. The club further includes: an upper wire-end retainer assembly including a cap-shaped outer tension tuner member having a cylindrical outer surface attached to the grip upper portion and an internal thread; a cylindrical collar having an outer surface and an internal thread which extends upwardly in a cylindrical inner tension tuner member having an external thread in threaded combination with the internal thread of the outer tension tuner member, and an internal thread; a cylindrical outer twist-prevention housing having an upper portion with a polygonal bore and an external thread in threaded combination with the collar internal thread; an inner twist-prevention housing having a central portion with a polygonal cross-section disposed between a cylindrical upper portion having a bore and an external thread smoothly slidable within the bore of the inner tension tuner member and a cylindrical lower portion with an external thread, with the central portion of the inner twist-prevention housing closely received within the polygonal bore; a cap-shaped clamp having an internal thread in threaded combination with the external thread of the inner twist-prevention housing, with the clamp tightening a bifurcated collet having opposed jaws received within the bore of the inner twist-prevention housing upper portion. The outer tension tuner member, cap-shaped clamp, collet, collar, inner tension tuner member, outer twist-prevention housing upper portion, and inner twist-prevention upper portion are received within the cavity, and the retainer assembly moves longitudinally within the cavity when the handle is rotated.

The club further includes: a hollow inflexible shaft upper portion, symmetric about a longitudinal axis and covered by a grip lower portion, into which the outer and inner twist-prevention housings extend; a hollow flexible shaft central portion, symmetric about the axis and attached to the shaft upper portion; and a hollow inflexible shaft lower portion attached to the shaft central portion and symmetric about the axis.

The club further includes a lower wire-end retainer assembly including a cylindrical sleeve extending in a cylindrical flange, and a ring received within the flange. The flange is rigidly attached to the shaft lower portion at its lower end.

The club further includes a metallic wire having opposed upper and lower ends disposed along the axis. The upper end is clamped between the collet jaws, and the lower end is attached to the ring. Moving the upper wire-end longitudinally alters the tension on the wire.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
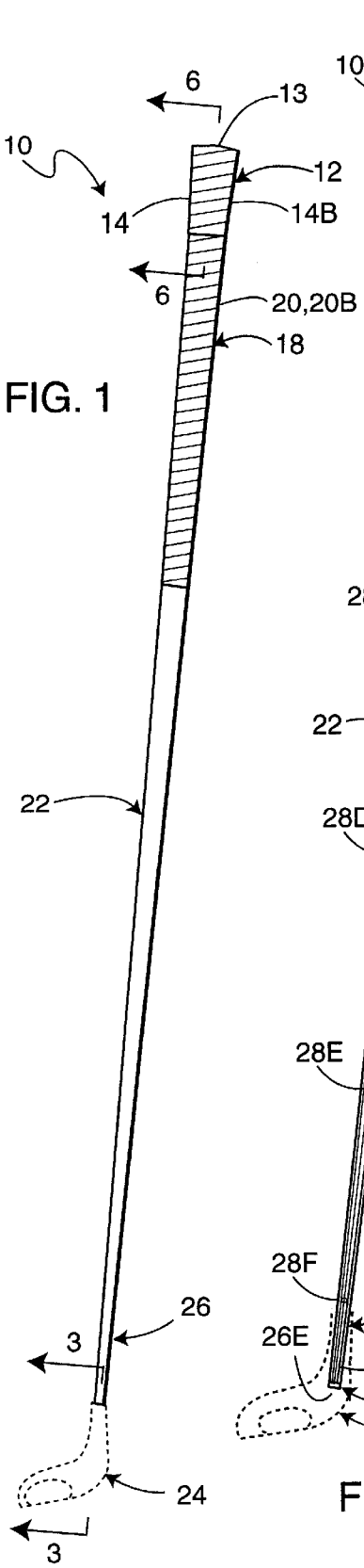
FIG. 1 is a perspective view of a golf club with a hollow shaft and clubhead according to the invention.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

Where used herein, the word "connected" means that the two parts referred to (e.g., an external thread and a nut, or the mating of external and internal threads) can be readily separated after being joined together in an interlocking combination. Where used herein, the words "attached" and "attachment" mean that the two parts referred to are either fabricated in a single piece, or glued, clamped or crimped together. However, other forms of attachment may be suitable, consistent with simplicity of manufacture and reliability of operation.

Figure 2:
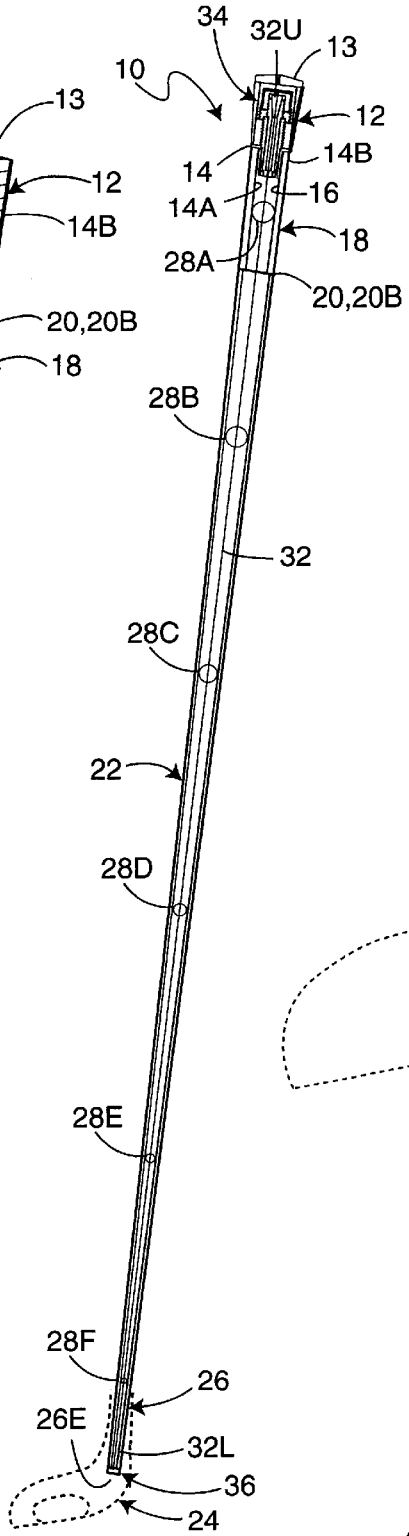
FIG. 2 is a longitudinal sectional view of the FIG. 1 club showing a longitudinally adjustable upper wire-end retainer assembly, a fixed lower wire-end retainer assembly, and a tension wire along the shaft longitudinal axis passing through and centered by six wire support members and clamped between the two assemblies.
Figure 8:
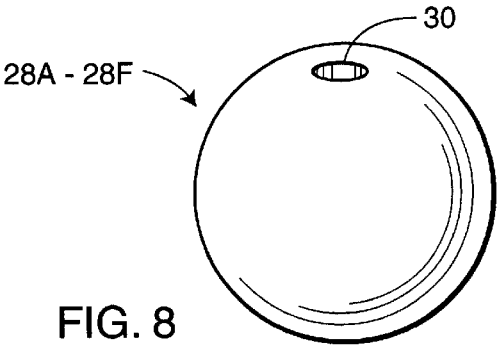
FIG. 8 shows one of a plurality of wire support members which is generally spherical and has therethrough a diametral bore.

Referring to FIGS. 1 and 2, a golf club 10 includes a rotatable handle 12 including a cap portion 13 and a grip upper portion 14 having a generally cylindrical interior surface 14A and a textured symmetrically tapering exterior surface 14B, the interior surface and cap portion determining a generally cylindrical cavity 16. Club 10 further includes a hollow inflexible, downwardly tapering shaft upper portion 18 covered by a grip lower portion 20 having a textured symmetrically tapering exterior surface 20B, a hollow flexible, downwardly tapering shaft central portion 22, a hollow clubhead 24 (not part of the invention), and a hollow inflexible shaft lower portion 26 extending into and rigidly attached at an end 26E to the clubhead. The handle and shaft upper, central and lower portions are symmetric about a common longitudinal axis. Cap portion 13 and grip portions 14 and 20 are conventionally made of a vulcanized rubber. Disposed along and within the shaft upper, central and lower portions is a plurality of wire support members 28A, 28B, 28C, 28D, 28E, 28F, progressively downwardly smaller in size, each of which is generally spherical and has therethrough a diametral bore 30 (see FIG. 8). Preferably, the number of support members is six; alternatively, five or seven members can be used. Alternatively, the members can be conical frustums sized to match the shaft's internal taper. The support members are fabricated from a low friction coefficient material such as a synthetic resinous fluorine-containing polymer or a polyvinyl chloride (PVC) and are rigidly attached to the shaft upper, central and lower portions, preferably adhesively, so that each bore is aligned with the longitudinal axis.

Figure 3:
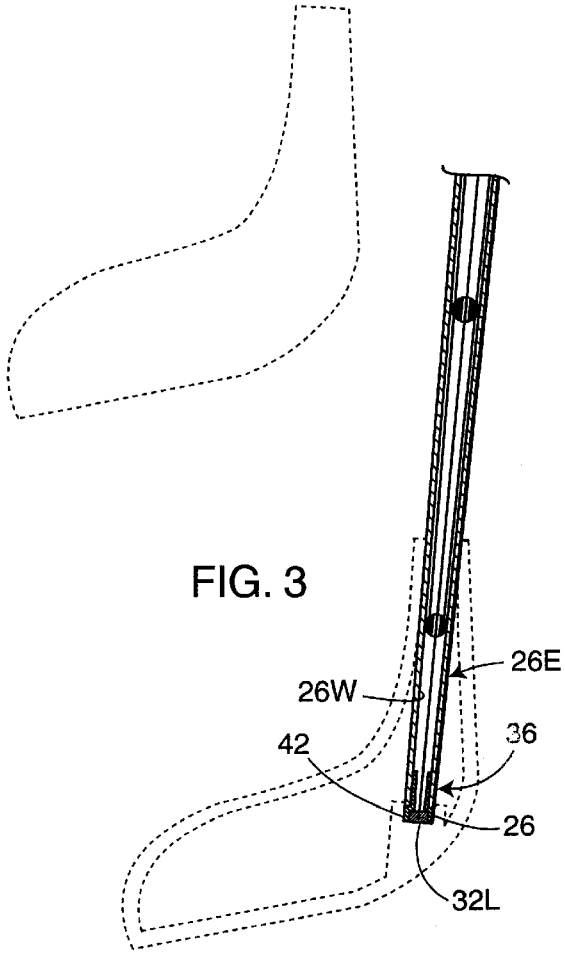
FIG. 3 is a greatly enlarged sectional view taken along line 3—3 in FIG. 1 showing the FIG. 2 lower wire-end retainer assembly including a flanged sleeve and a ring, and the wire lower portion and two lowermost support members.
Figure 6:
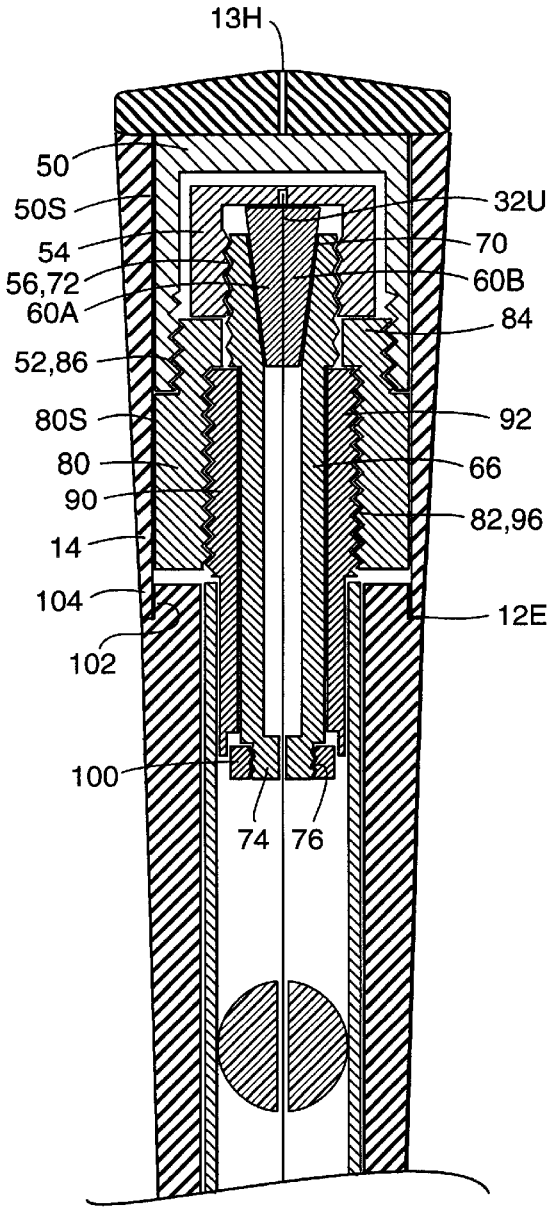
FIG. 6 is a greatly enlarged sectional view taken along line 6—6 in FIG. 1 showing the upper wire-end retainer assembly in its lowermost position resulting in minimum wire tension.

Referring to FIG. 2, a tension wire 32 is clamped at opposed upper and lower ends 32U, 32L to, respectively, an upper wire-end retainer assembly 34 closely received within the cavity 16, and a lower wire-end retainer assembly 36 closely received within and rigidly attached to the shaft lower portion end 26E. As best shown in FIGS. 3 and 6, the wire 32 is threaded through each bore 30 so that the wire is constrained to be disposed along the longitudinal axis. The bores are sized to closely receive but not frictionally interfere with the wire. Preferably, the wire is made from a stainless steel having a Rockwell hardness in the range 40–70, and has a constant diameter in a range from 0.060- to 0.090-inch. Alternatively, the wire is made from a carbon steel having a Rockwell hardness in the range 40–75 with a constant diameter in a range from 0.031- to 0.064-inch, or from tungsten having a Rockwell hardness in the range 75–80 with a constant diameter in a range from 0.031- to 0.055-inch.

Figure 4:
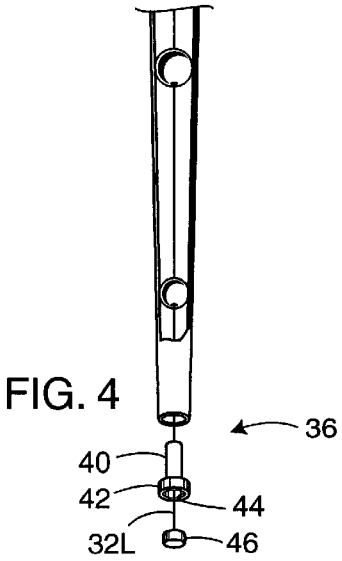
FIG. 4 is an exploded perspective view of the FIGS. 2, 3 lower wire-end retainer assembly, and a partial sectional view of the shaft lower portion.

Referring to FIGS. 3 and 4, lower wire-end retainer assembly 36 includes a generally cylindrical sleeve 40 extending in a generally cylindrical flange 42, the sleeve and flange having therethrough a common bore 44. A generally circular ring 46 is closely received within the flange. After inserting wire-end 32L through the sleeve and into the ring and flange, the wire-end is rigidly attached to the retainer assembly by crimping the ring which, with the wire under tension, is disposed within the flange and constrained upwardly by the relatively narrow diameter sleeve. Flange 42 is rigidly attached to inner wall 26W of lower shaft portion 26 at end 26E, thereby providing additional structural integrity to the shaft-clubhead juncture.

Figure 5:
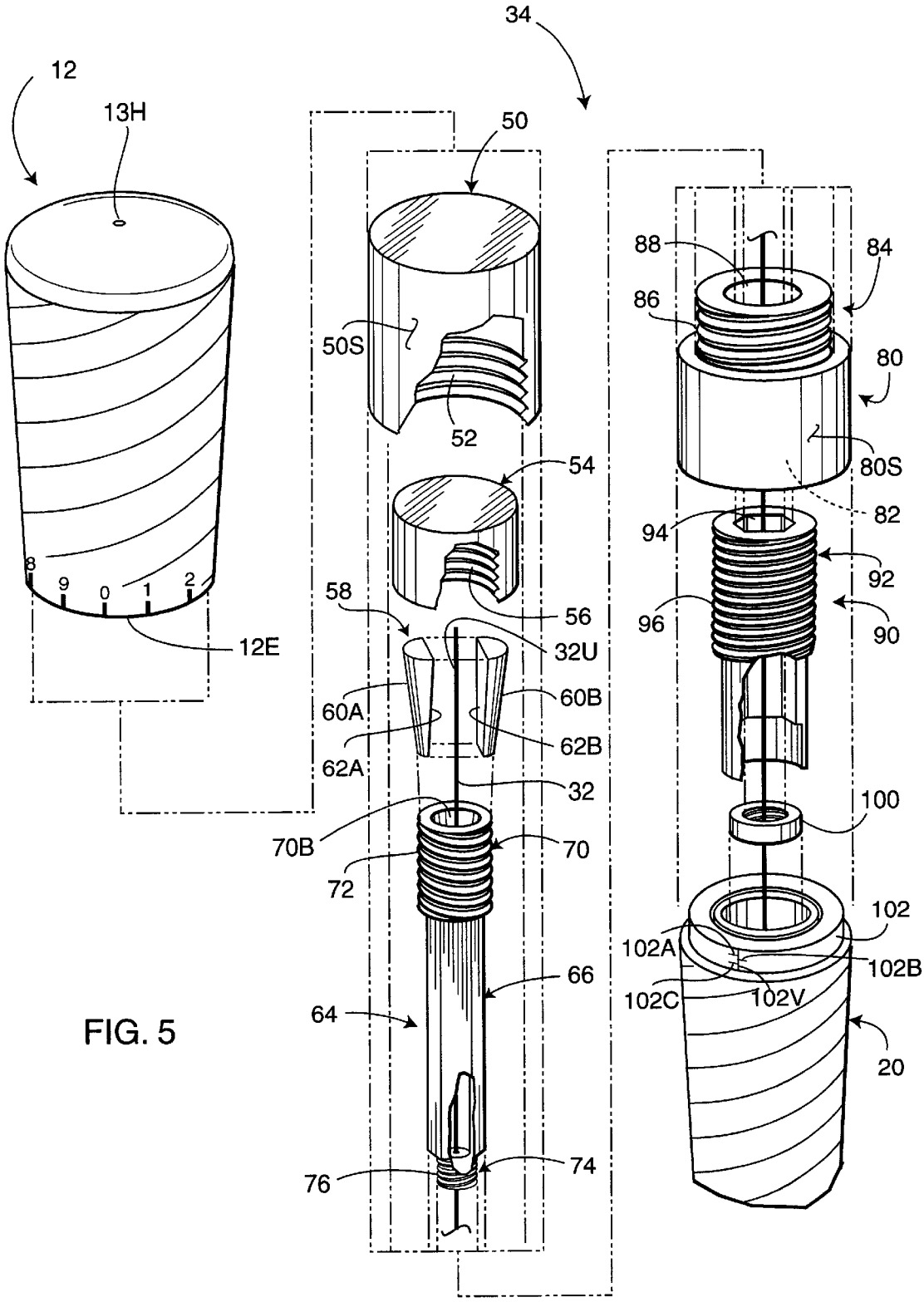
FIG. 5 is an exploded perspective and partial sectional view of the FIG. 1 club handle and upper wire-end retainer assembly, the assembly including a cap-shaped outer tension tuner member, a cap-shaped collet clamp, a bifurcated collet, an inner twist-prevention housing, a collar extending upwardly in an inner tension tuner member, an outer twist-prevention housing, and a stop nut.
Figure 7:
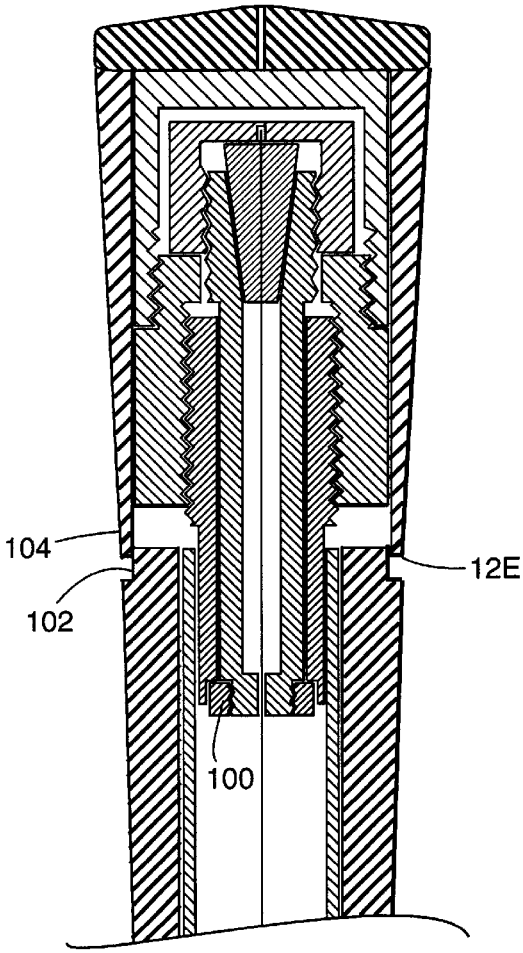
FIG. 7 shows the same view as FIG. 6 when the upper wire-end retainer is in its uppermost position resulting in maximum wire tension.

Referring to FIGS. 5 and 6, the upper wire-end retainer assembly 34 includes a cap-shaped outer tension tuner member 50 having an internal thread 52 and an outer surface 50S, a cap-shaped collet clamp 54 having an internal thread 56, a bifuracted collet 58 having jaws 60A, 60B with generally planar inner faces 62A, 62B, respectively, and an inner twist-prevention housing 64 having a central portion 66 with a polygonal cross-section disposed between a generally cylindrical upper portion 70 with a bore 70B and an external thread 72, and a generally cylindrical lower portion 74 with an external thread 76. Wire 32 is rigidly attached to the assembly 34 when wire-end 32U is gripped between faces 62A, 62B with the collet 58 received within the bore 70B and the clamp screwed onto member 62 by engaging threads 56 and 72. As shown in FIG. 5, handle 12 has a circumferential lower edge 12E proximate to which are ten embossed numerical indicia "0, 1, 2, 3, 4, 5, 6, 7, 8, 9" evenly spaced around the circumference. Handle 12 is adhesively attached to surface 50S so that when the handle is rotated through a preselected angle the tuner member 50 also rotates through that angle. As shown in FIGS. 5, 6 and 7, cap portion 13 has therethrough an air release hole 13H to allow air to escape from the hollow club 10 when the club is assembled.

Referring again to FIGS. 5 and 6, assembly 34 further includes a generally cylindrical collar 80 having an outer surface 80S adhesively attached to grip upper portion 14 and an internal thread 82. Collar 80 extends upwardly in a generally cylindrical inner tension tuner member 84 having an external thread 86 and a smooth bore 88. Assembly 34 further includes a generally cylindrical outer twist-prevention housing 90 having an upper portion 92 with a polygonal bore 94 therethrough and an external thread 96. Bore 94 closely receives central portion 66 of housing 64; member 50 is screwed onto member 84 by engaging threads 52 and 86; the lower portion of thread 72 is smoothly slidable within bore 88; and member upper portion 92 cooperates with collar 80 through engagement of threads 82 and 96. A stop-nut 100 is screwed onto thread 76.

Referring to FIGS. 6 and 7, when handle 12 is rotated, outer tension tuner member 50 moves through the same angle as does inner tension tuner member 84. Thread pairs (52, 86) and (56, 72) are right-handed while thread pair (82, 96) is left-handed, so rotating the handle clockwise causes the entire upper wire-end retainer assembly 34 to translate upwards, thereby increasing the tension on wire 32, while the wire is protected from being twisted by the interaction of housings 64 and 90. Conversely, rotating the handle counterclockwise causes assembly 34 to translate downwards, decreasing the wire tension. Preferably, the pitch of the thread pairs is such that assembly 34 moves about 1.75 mm for one complete rotation of handle 12.

Referring to FIG. 5, grip lower portion 20 terminates upwardly in a shoulder 102 on which is embossed a vertical index 102V and upper, middle and lower horizontal indices 102A, 102B, 102C, respectively. Index 102V allows precise alignment with one of the numerical indicia proximate to edge 12E so a desired shaft flexibility can be reproduced. As shown in FIGS. 6 and 7, shoulder 102 mates with a shoulder 104 in grip upper portion 14 proximate to edge 12E. FIG. 6 shows assembly 34 when the handle is rotated fully counterclockwise so the assembly is at its extreme downward position where the shoulders mate. In this position, edge 12E touches lower index 102C. FIG. 7 shows the assembly when the handle is rotated fully clockwise so the assembly is at its extreme upward position where the shoulders 102, 104 are at maximum separation. In this position, edge 12E touches upper index 102A. Stop nut 100 prevents the handle from being rotated too far.

Increasing the tension of wire 32 causes the shaft central portion 22 to flex more on the backswing than it otherwise would, storing additional potential energy as the top of the swing is reached. During the downswing this energy is converted into kinetic energy, a process analogous to releasing a bow-string to propel an arrow. This kinetic energy is imparted to the clubhead, resulting in a more powerful impact, compared to using a conventional club, as the clubhead contacts the ball.

What is claimed is:

1. A golf club comprising:

a handle with a cavity rotatably connected to a hollow shaft upper portion symmetric about a longitudinal axis;

a hollow flexible shaft central portion, symmetric about said axis, attached at an upper end to the shaft upper portion and attached at a lower end to a hollow shaft lower portion symmetric about said axis, the lower portion terminating in an end; and means for altering the tension on a metallic wire having opposed upper and lower wire-ends disposed along said axis, the upper wire-end at a longitudinally adjustable position within the handle cavity, the lower wire-end attached to the shaft lower portion end.

2. The golf club of claim 1, wherein said means for altering the wire tension comprises an upper wire-end retainer assembly comprising a cap-shaped outer tension tuner member having a generally cylindrical outer surface and an internal thread, a generally cylindrical collar having an outer surface and an internal thread, the collar extending upwardly in a generally cylindrical inner tension tuner member having an external thread and a generally cylindrical smooth bore, said external thread in threaded combination with the internal thread of the outer tension tuner member, a generally cylindrical outer twist-prevention housing having an upper portion with a polygonal bore therethrough and an external thread, said external thread in threaded combination with the collar internal thread, an inner twist-prevention housing having a central portion with a polygonal cross-section disposed between a generally cylindrical upper portion having a bore and an external thread and a generally cylindrical lower portion with an external thread, said upper portion external thread smoothly slidable within the bore of the inner tension tuner member, the central portion of the inner twist-prevention housing closely received within said polygonal bore, a cap-shaped clamp having an internal thread in threaded combination with the external thread of the inner twist-prevention housing, said clamp tightening a bifurcated collet having opposed jaws received within the bore of the inner twist-prevention housing upper portion, the collet jaws clamping the upper wire-end, the outer tension tuner member, cap-shaped clamp, collet, collar, inner tension tuner member, outer twist-prevention housing upper portion, and inner twist-prevention upper portion received within said handle cavity, the outer and inner twist-prevention housings extending into the shaft upper portion.

3. A golf club comprising:

a handle having a cap portion and a rotatable grip upper portion having a generally cylindrical interior surface and a textured symmetrically tapering exterior surface, the interior surface and cap portion determining a cavity;

an upper wire-end retainer assembly comprising a cap-shaped outer tension tuner member having a generally cylindrical outer surface attached to the grip upper portion and an internal thread, a generally cylindrical collar having an outer surface attached to the grip upper portion and an internal thread, the collar extending upwardly in a generally cylindrical inner tension tuner member having an external thread and a generally cylindrical smooth bore, said external thread in threaded combination with the internal thread of the outer tension tuner member, a generally cylindrical outer twist-prevention housing having an upper portion with a polygonal bore therethrough and an external thread, said external thread in threaded combination with the collar internal thread, an inner twist-prevention housing having a central portion with a polygonal cross-section disposed between a generally cylindrical upper portion having a bore and an external thread and a generally cylindrical lower portion with an external thread, said upper portion external thread smoothly slidable within the bore of the inner tension tuner member, the central portion of the inner twist-prevention housing closely received within said polygonal bore, a cap-shaped clamp having an internal thread in threaded combination with the external thread of the inner twist-prevention housing, said clamp tightening a bifurcated collet having opposed jaws received within the bore of the inner twist-prevention housing upper portion, the outer tension tuner member, cap-shaped clamp, collet, collar, inner tension tuner member, outer twist-prevention housing upper portion, and inner twist-prevention upper portion received within said cavity, said retainer assembly moving longitudinally within said cavity when the handle is rotated;

a hollow inflexible downwardly tapering shaft upper portion, symmetric about a longitudinal axis and covered by a grip lower portion, the outer and inner twist-prevention housings extending into the shaft upper portion;

a hollow flexible downwardly tapering shaft central portion, symmetric about said axis and attached to the shaft upper portion;

a hollow inflexible shaft lower portion having an inner wall, said lower portion attached to the shaft central portion and symmetric about said axis and terminating at a lower end;

a lower wire-end retainer assembly comprising a generally cylindrical sleeve extending in a generally cylindrical flange, the sleeve and flange having therethrough a common bore, a ring received within the flange, the flange rigidly attached to said inner wall at said lower end; and a metallic wire having opposed upper and lower wire-ends disposed along said axis, the upper wire-end clamped between said collet jaws, the lower wire-end attached to said ring, a preselected longitudinal movement of the upper wire-end retainer assembly resulting in a predetermined tension on the wire.

4. The golf club of claim 3, further comprising a plurality of support members each having a bore therethrough, the bores aligned with said longitudinal axis, the wire passing through each bore.

5. The golf club of claim 4, wherein the support members are fabricated from a material having a low friction coefficient.

6. The golf club of claim 5, wherein the wire is made from a stainless steel having a Rockwell hardness in a range of 40 to 70, and has a constant diameter in a range from 0.060- to 0.090-inch.

7. The golf club of claim 5, wherein the wire is made from a carbon steel having a Rockwell hardness in a range of 40 to 75, and has a constant diameter in a range from 0.031- to 0.064-inch.

8. The golf club of claim 5, wherein the wire is made from tungsten having a Rockwell hardness in a range of 75 to 80, and has a constant diameter in a range from 0.031- to 0.055-inch.

* * * * *